US006804588B2

(12) United States Patent
Oki et al.

(10) Patent No.: US 6,804,588 B2
(45) Date of Patent: Oct. 12, 2004

(54) SYSTEM FOR DETECTING MALFUNCTION OF INTERNAL COMBUSTION ENGINE RADIATOR

(75) Inventors: Hideyuki Oki, Wako (JP); Takashi Isobe, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/268,999

(22) Filed: Oct. 11, 2002

(65) Prior Publication Data

US 2003/0074117 A1 Apr. 17, 2003

(30) Foreign Application Priority Data

Oct. 12, 2001 (JP) ..... 2001-315210

(51) Int. Cl.[7] ..... G01M 17/00; G06F 19/00; G06F 7/00

(52) U.S. Cl. ..... 701/29; 701/30; 701/33; 701/101; 701/108; 701/110; 701/114; 701/115; 123/41.01; 123/41.15; 123/350; 123/568.12; 123/568.15; 123/568.22; 73/116; 73/118.1; 141/7

(58) Field of Search ..... 701/29, 108, 101, 701/110, 33, 114, 115, 30; 73/118.1, 116; 123/350, 568.12, 568.22, 41.15, 41.01; 141/7, 230, 382, 65, 92, 98, 95

(56) References Cited

U.S. PATENT DOCUMENTS 4,465,129 A * 8/1984 Baldensperger et al. .... 165/153
5,042,568 A * 8/1991 Fehlhafer ..... 165/51
6,050,333 A * 4/2000 Albaroudi ..... 165/281
6,240,774 B1 * 6/2001 Niki et al. ..... 73/118.1
6,279,390 B1 * 8/2001 Oka et al. ..... 73/118.1
6,367,256 B1 * 4/2002 McKee ..... 60/605.2
6,675,437 B1 * 1/2004 York ..... 15/321
2003/0023367 A1 * 1/2003 Avery et al. ..... 701/110
2003/0101961 A1 * 6/2003 Foster ..... 123/198 F
2003/0114978 A1 * 6/2003 Rimnac et al. ..... 701/108
2003/0127077 A1 * 7/2003 Sisken ..... 123/568.11
2003/0131659 A1 * 7/2003 Oka et al. ..... 73/118.1

FOREIGN PATENT DOCUMENTS

JP 2000-008853 1/2000

OTHER PUBLICATIONS

Radiator, Cooling System, 2000, Internet, pp. 6–17–40.*
Buksa et al., Sprite: A computer code for the optimization of space based heat pipe radiator systems, 1989, IEEE, pp. 39–44.*
Trujilo et al., Design and demostration of a high–temperature, deployable, membrane heat–pipe radiator element, 1989, IEEE, pp. 1891–1895.*
Begg et al., Advanced radiator concepts, 1989, IEEE, pp. 75–80.*

* cited by examiner

*Primary Examiner*—William A. Cuchlinski, Jr.
*Assistant Examiner*—McDieunel Marc
(74) *Attorney, Agent, or Firm*—Arent Fox PLLC

(57) ABSTRACT

A system for discriminating malfunction of a radiator of an internal combustion engine, in which conditions for execution of malfunction discrimination of the radiator are decided to be established, when a decline amount of outside air temperature is less than a threshold value, and the malfunction discrimination is conducted by comparing an estimated and detected coolant temperatures with predetermined values. In the system, making the decision that the conditions are not established is prevented, utilizing a parameter related to a quantity of intake air. With this, it becomes possible to inhibit decisions finding that the conditions are not established in certain cases in which such a decision would ordinarily be unreasonably made, such as when the internal combustion engine is started while still insufficiently soaked, etc., so that heat in the intake manifold installed with the outside air temperature sensor causes a transient or momentary decline in the outside air temperature sensor detection value during high-load operation immediately after engine starting.

13 Claims, 11 Drawing Sheets

SYSTEM FOR DETECTING MALFUNCTION OF INTERNAL COMBUSTION ENGINE RADIATOR

BACKGROUND OF THE INVENTION

1. Field of the Invention

This invention relates to a system for detecting or discriminating malfunction of an internal combustion engine radiator, more particularly to a system for detecting or discriminating malfunction of a radiator thermostat.

2. Description of the Related Art

The internal combustion engine of a vehicle is connected through a communicating passage with a radiator for cooling a coolant. A thermostat (a shut-off valve) is installed in the communicating passage. The thermostat closes the communicating passage when the coolant temperature is low, such as at engine starting, and opens it when the temperature rises so as to pass coolant into the radiator for cooling.

The radiator is one of the on-board components of a vehicle. The ability to detect or discriminate radiator malfunction is therefore desirable. It was for this purpose that the assignee developed a system that first checks whether the engine is in a state cooled to a temperature equal to the outside air temperature (intake air temperature) owing to thorough soaking (long-period or sufficient standing) and whether change in the outside air temperature since engine starting is small, then, when these conditions are met decides that the conditions for execution of malfunction detection have been established, whereafter it carries out a calculation for estimating the coolant temperature and decides that the radiator, more precisely the radiator thermostat, is faulty if, for example, the detected coolant temperature has not reached the judge-normal value when the estimated coolant temperature reaches the judge-malfunction value. This technology is described in the assignee's Japanese Laid-Open Patent Application 2000-8853.

However, when the outside air temperature sensor is installed in the intake manifold for convenience of layout, the value of the air temperature detected by the air temperature sensor may be higher than the actual air temperature even when the vehicle has thoroughly soaked because of heat accumulated in the intake manifold owing to sun exposure. In such a case, the sensor detection value may decline sharply immediately after engine starting due to the intake of air under the high-load operation at this time. In addition, heat in the intake manifold may also make it impossible for the sensor detection value to accurately track the air temperature when the rate of air temperature decline is high. In this case, too, the sensor detection value may decline sharply immediately after engine starting due to the intake of air under the high-load operation at this time.

When the value of the outside air temperature detected by the air temperature sensor declines sharply during the high-load operation immediately after engine starting in this way, the conventional system is liable to judge that the conditions for execution of radiator malfunction detection have not been established. However, the sharp decline in the sensor detection value is a transient or momentary phenomenon caused by dispersion of the heat in the intake manifold and is not a substantial hindrance to malfunction detection or discrimination.

SUMMARY OF THE INVENTION

An object of this invention is therefore to offer an improvement on the assignee's earlier developed technology, specifically to provide a system for detecting or discriminating malfunction of an internal combustion engine radiator that enables highly accurate detection or discrimination of internal engine radiator malfunction and that inhibits or prevents a decision finding that conditions for execution of malfunction detection or discrimination are not established when dispersion of the heat in the intake manifold installed with the outside air temperature sensor causes a transient or momentary decline in the outside air temperature sensor detection value during high-load operation immediately after engine starting.

The present invention achieves the object by providing a system for discriminating malfunction of a radiator having an inlet pipe connected to an internal combustion engine and a thermostat fitted in the inlet pipe (communicating passage) to open the inlet pipe to pass engine coolant in the radiator to cool, comprising: engine operating condition detecting means for detecting operating conditions of the engine including at least an outside air temperature and a coolant temperature; outside air temperature decline amount calculating means for calculating a decline amount of the detected outside air temperature since starting of the engine; malfunction discrimination execution condition establishing deciding means for comparing the calculated decline amount of the detected outside air temperature with a threshold value and for making a decision that conditions for execution of malfunction discrimination of the radiator are established, when the calculated decline amount of the detected outside air temperature is less than the threshold value; estimated coolant temperature calculating means for calculating an estimated coolant temperature based on at least the detected coolant temperature and a thermal load parameter contributing to coolant temperature rise, when the malfunction discrimination execution condition establishing deciding means makes the decision that the conditions are established; and malfunction discrimination executing means for comparing the estimated coolant temperature and the detected coolant temperature with predetermined values and for discriminating whether the radiator has malfunctioned based on results of comparison; wherein the improvement comprises: malfunction discrimination execution condition non-establishing preventing means for preventing the malfunction discrimination execution condition establishing deciding means from making the decision that the conditions are not established, utilizing a parameter related to a quantity of intake air.

BRIEF DESCRIPTION OF THE DRAWINGS

The objects and advantages of the invention will be made apparent with reference to the following descriptions and drawings, in which.

DETAILED DESCRIPTION OF THE PREFERRED EMBODIMENTS

Embodiments of this invention will now be explained with reference to the attached drawings.

Figure 1:
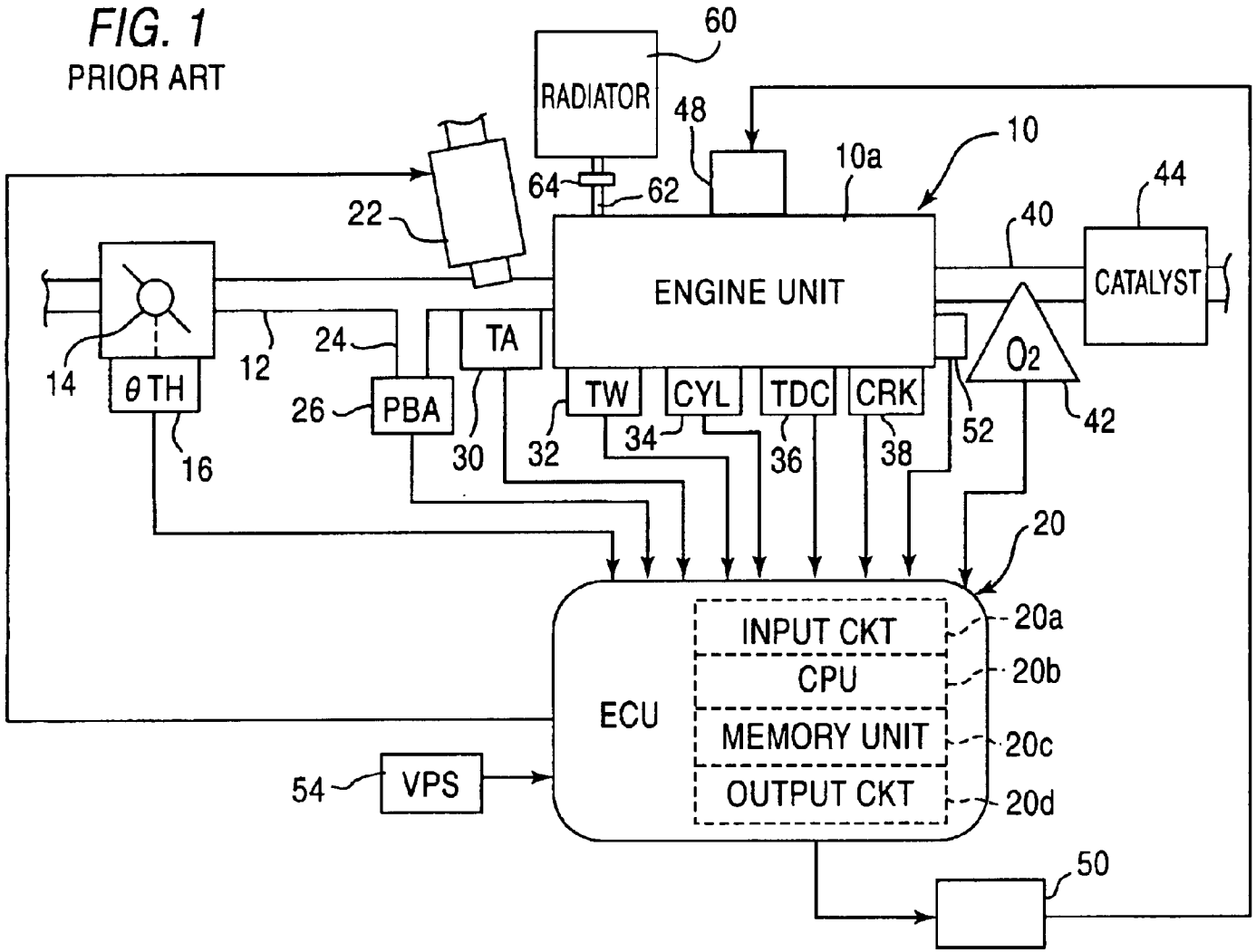
FIG. 1 PRIOR ART
FIG. 1 is a schematic overview of a system for detecting or discriminating malfunction of an internal combustion engine radiator according to an embodiment of the present invention.

FIG. 1 is a schematic overview of a system for detecting or discriminating malfunction of an internal combustion engine radiator according to an embodiment of the present invention.

Reference numeral 10 in FIG. 1 designates a four-cylinder, four-cycle internal combustion engine. An air intake pipe 12 equipped with a throttle valve 14 is connected to the main engine unit 10*a* of the engine 10. A throttle opening sensor 16 coupled with the throttle valve 14 produces and sends to an ECU (Electronic Control Unit) 20 an electric signal representing the opening θ TH.

Downstream of the throttle valve, the air intake pipe 12 forms an intake manifold (not shown). For each cylinder, a fuel injector 22 is provided in the intake manifold at a point upstream of an intake valve (not shown) of the cylinder. The injectors 22 are mechanically connected to a fuel pump (not shown) that supplies them with pressurized fuel and are electrically connected to the ECU 20. The ECU 20 controls the valve open time of the injectors 22 and each injector 22 injects (supplies) pressurized fuel to the region of the intake valves while open.

A manifold absolute pressure sensor 26 connected with the air intake pipe 12 through a branch pipe 24 downstream of the throttle valve 14 produces an electric signal representing the pressure (absolute pressure) PBA in the air intake pipe 12. An outside air temperature (intake air temperature) sensor 30 attached to the air intake pipe 12 downstream of the absolute pressure sensor 26 outputs an electric signal representing the outside air temperature (intake air temperature) TA. A coolant temperature sensor 32 installed near a coolant passage (not shown) of the main engine unit 10*a* outputs an electric signal representing the engine coolant temperature TW.

A cylinder discrimination sensor 34 installed near the camshaft or crankshaft (neither shown) of the engine 10 outputs a cylinder discrimination signal CYL every time the piston of a certain cylinder reaches a prescribed position. A TDC sensor 36 installed near the camshaft or crankshaft (neither shown) outputs a TDC signal pulse once every crank angle (e.g., BTDC 10 degrees) associated with the TDC (Top Dead Center) position of the piston of each cylinder. A similarly installed crank angle sensor 38 outputs CRK pulse signals at a shorter crank angle period (every 30 degrees) than the period of the TDC signal pulses.

In the exhaust system of the engine 10, an air/fuel ratio ($O_2$) sensor 42 is installed at an appropriate portion of an exhaust pipe 40 connected to the exhaust manifold (not shown). The air/fuel ratio sensor 42 outputs a signal representing the oxygen concentration $O_2$ of the exhaust gas. A three-way catalytic converter 44 provided downstream of the air/fuel ratio sensor 42 removes HC, CO and $NO_x$ components from the exhaust gas. Spark plugs 48 associated with the respective combustion chambers (not shown) of the engine 10 are electrically connected to the ECU 20 through an ignition coil and an ignitor 50.

A knock sensor 52 mounted on the cylinder head (not shown) of the main engine unit 10*a* outputs a signal representing vibration of the engine 10. Further, a vehicle speed sensor 54 mounted in the vicinity of the drive shaft (not shown) of the vehicle powered by the engine 10 outputs a pulse once every unit rotation of the vehicle wheels.

The outputs of these sensors are sent to the ECU 20. The ECU 20, which is constituted as a microcomputer, comprises an input circuit 20*a* for receiving input signals from the aforesaid sensors and subjecting them to wave shaping, conversion to prescribed voltage level and conversion from analog to digital form, a CPU (central processing unit) 20*b* for conducting logical operations, a memory unit 20*c* for storing processing programs executed by the CPU, processed data and the like, and an output circuit 20*d*.

The output of the knock sensor 52 is sent to a detection circuit (not shown) in the ECU 20, where it is compared with a knock discrimination level obtained by amplifying the noise level. The CPU 20*b* uses the output of the detection circuit to discriminate whether knock occurs in the combustion chambers. The CPU 20*b* also calculates the engine speed NE from the counted number of CRK signal pulses and calculates the vehicle speed VPS from the counted number of output pulses from the vehicle speed sensor 54.

The CPU 20*b* also retrieves a basic ignition timing from a predefined map stored in the memory unit 20*c* using the detected engine speed NE and the manifold absolute pressure PBA (an engine load parameter) as address data, adjusts the basic ignition timing based on the engine coolant temperature TW etc. and further retards the basic ignition timing if engine knock has been detected. The CPU 20*b* also decides the quantity of fuel injection in terms of injector open time and drives the injectors 22 through the output circuit 20*d* and a drive circuit (not shown).

A radiator 60 is connected to the engine 10.

Figure 2:
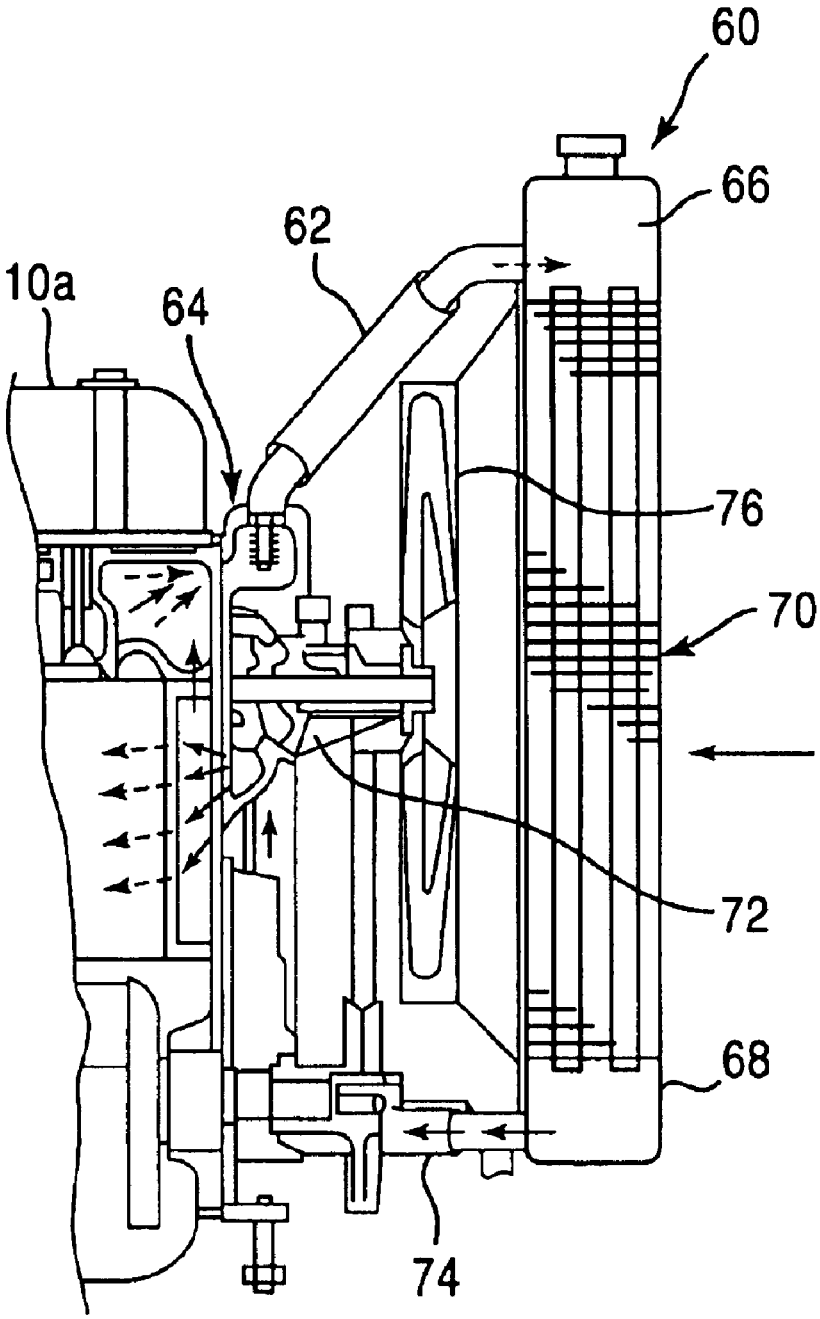
FIG. 2 PRIOR ART
FIG. 2 is an explanatory side sectional view showing the details of a radiator illustrated in FIG. 1.

FIG. 2 is an explanatory side sectional view showing the details of the radiator 60.

As illustrated, the radiator 60 is connected to the engine main unit 10*a* through an inlet pipe (communicating passage) 62. A thermostat 64 is fitted in the inlet pipe 62. The radiator 60 has an upper tank 66 at the top, a lower tank 68 at the bottom, and a honeycomb core 70 accommodated in the intervening space. The inlet pipe 62 is connected to the upper tank 66 and an outlet pipe 74 is connected to the lower tank 68. A water pump 72 pressurizes coolant in the coolant passage of the engine unit 10*a* so as to circulate it through the inlet pipe 62, the upper tank 66, the core 70, the outlet pipe 74 and back to the coolant passage of the engine unit 10*a*.

As indicated by an arrow in FIG. 2, the core 70 is cooled by air flowing in from the direction of vehicle travel. A forced flow of cooling air is further produced by a fan 76 located behind the radiator and driven by the engine.

The thermostat 64 is a shut-off valve operated by a bimetallic strip. At engine starting, when the coolant temperature is low, the thermostat 64 closes the inlet pipe 62 to prevent coolant from flowing into the radiator 60. Then, as the coolant temperature rises, it progressively opens the inlet pipe 62 so that the coolant flows in contact with the core 70 to be cooled and is then returned to the engine coolant passage.

As explained further later, in the foregoing arrangement the ECU 20 responds to establishment of conditions for execution of thermostat malfunction detection or discrimination by using the aforesaid sensor outputs to calculate (estimate) the temperature of the coolant and then determines (detects or discriminates) whether the thermostat 64 has malfunctioned.

The operation of the system for detecting or discriminating malfunction of an internal combustion engine radiator according to this embodiment will now be explained with reference to the flow chart of FIG. 3. The illustrated program is executed at prescribed intervals of, for example, 2 sec.

First, in S10, it is checked whether the engine 10 is in starting mode. This is done by first checking whether the starter motor (not shown) is operating and, if it is not, then checking whether the engine speed NE is has reached the cranking speed. If the result of either check is affirmative (YES), it is decided that the engine 10 is in starting mode.

When the result in S10 is YES, next, in S12, the values of the totalized engine load for coolant temperature estimation TITTL, the totalized cooling loss CLTTL, the post-engine-starting counter ctTRM (for clocking time elapsed after engine starting), and the totalized vehicle speed VPSTTL are set to zero and the estimated coolant temperature CTW is set to (overwritten with) the value of the engine-start-time estimated coolant temperature TWINIT. These parameters will be explained later.

When the result in S10 is NO, it is checked in S14 whether the bit of a flag F.MONTRM is set to 1. The bit of this flag being set to 1 means that the conditions for execution of thermostat malfunction detection or discrimination are established. This flag bit is set by checking whether conditions for execution of thermostat malfunction detection or discrimination are established in a separate subroutine.

Figure 4:
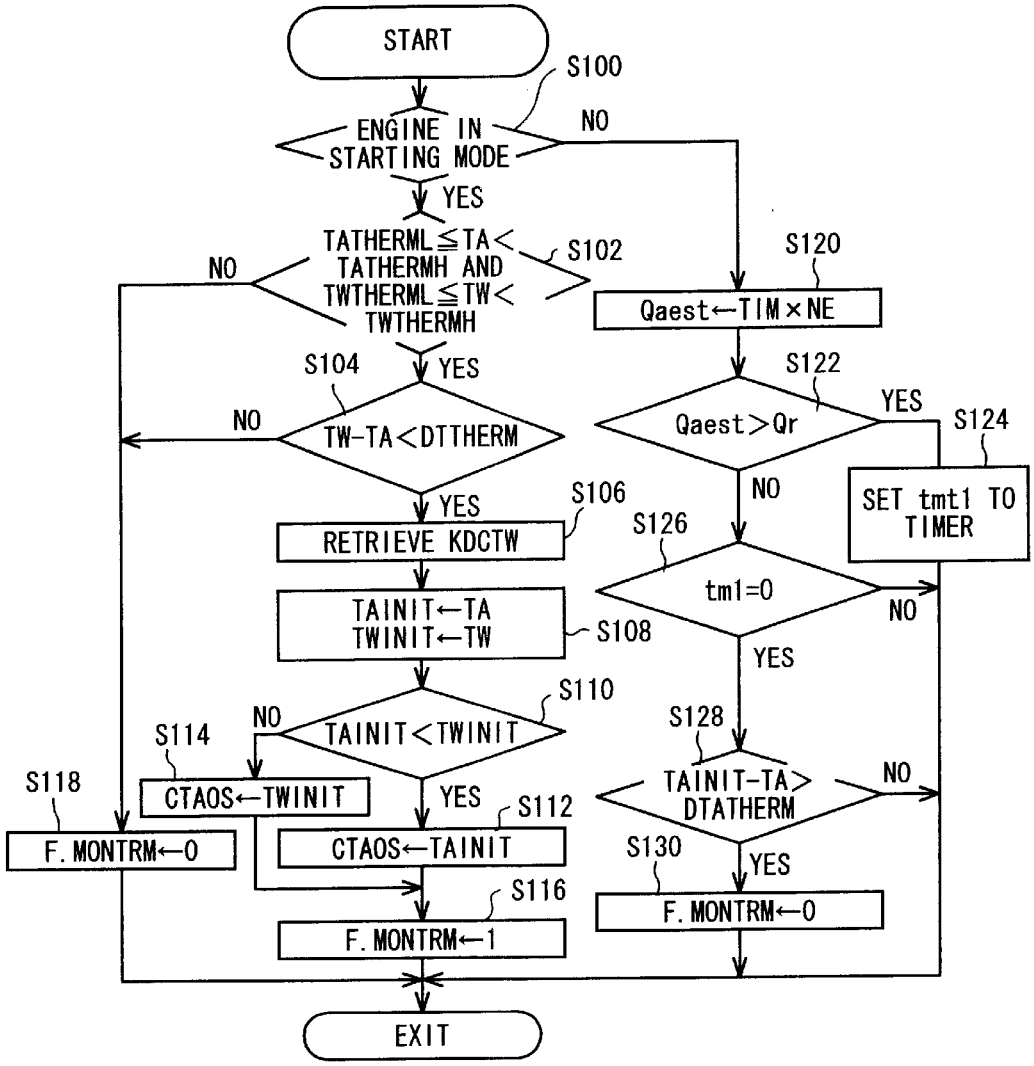
FIG. 4 is a flow chart showing determination of the bit of a flag F.MONTRM, i.e., a flow chart for determining whether conditions for execution of thermostat malfunction detection or discrimination are established., referred to in the flow chart of FIG. 3.

FIG. 4 is a flow chart showing the subroutine for determining whether conditions for execution of thermostat malfunction detection or discrimination are established. This subroutine is executed once every prescribed crank angle.

In S100, it is checked whether the engine 10 is in starting mode. The method described regarding S10 of FIG. 3 is used. When the result in S100 is YES, it is checked in S102 whether the outside air temperature (intake air temperature) TA detected by the air temperature sensor 30 is equal to or higher than a prescribed value TATHERML (e.g., −7° C.) and lower than a prescribed value TATHERMH (e.g., 50° C.), and whether the coolant temperature TW detected by the coolant temperature sensor 32 is equal to or higher than a prescribed value TWTHERML (e.g., −7° C.) and lower than a prescribed value TWTHERMH (e.g., 50° C.).

When the result in S102 is YES, then, in S104, the difference between the detected coolant temperature TW and air temperature TA is calculated and it is checked whether the calculated difference is less than a prescribed value DTTHERM (e.g., 10° C.).

Figure 5:
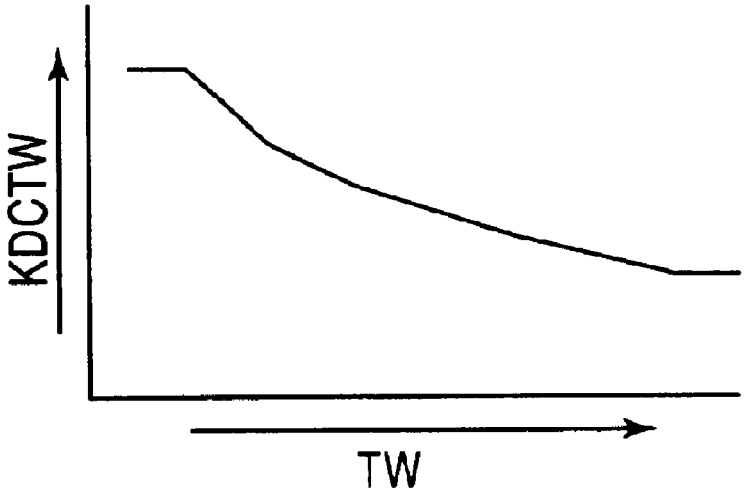
FIG. 5 PRIOR ART
FIG. 5 is a graph showing the characteristic curve of a coolant temperature estimation engine-start-time coolant temperature correction value KDCTW referred to in the flow chart of FIG. 4.

When the result in S104 is YES, then, in S106, the detected coolant temperature TW is used to retrieve a coolant temperature estimation engine-start-time coolant temperature correction value KDCTW (explained later) from a table compiled based on the characteristic curve shown in FIG. 5.

Next, in S108, the engine-start-time detected air temperature TAINIT is overwritten with the air temperature TA and the start-time detected coolant temperature TWINIT is overwritten with the coolant temperature TW.

Next, in S110, it is checked whether the just updated engine-start-time detected air temperature TAINIT is lower than the engine-start-time detected coolant temperature TWINIT. When the result is YES, CTAOS is overwritten with TAINIT in S112. When the result is NO, CTAOS is overwritten with TWINIT in S114.

CTAOS is the corrected engine-start-time air temperature. By these steps, the value of the engine-start-time air temperature is corrected to the lower of the engine-start-time detected coolant temperature TWINIT and the engine-start-time detected air temperature TAINIT.

Next, in S116, the bit of the flag F.MONTRM is set to 1 to indicate that conditions for execution of thermostat malfunction detection or discrimination are established.

When the result in S102 or S104 is NO, the bit of the flag F.MONTRM is reset to 0 in step S118 to indicate that conditions for execution of thermostat malfunction detection or discrimination are not established.

When the result in S100 is NO, then, in S120, the detected engine speed NE and manifold absolute pressure PBA are used as address data for retrieving a basic fuel injection quantity TIM from a map (not shown) and the retrieved basic fuel injection quantity TIM is multiplied by the engine speed NE to calculate an estimated intake air quantity Qaest (a parameter related to the quantity of intake air).

The basic fuel injection quantity TIM defines the valve open time of the injectors 22 but is essentially a value proportional to air intake quantity. In this embodiment, the value obtained by multiplying the basic fuel injection quantity TIM by the engine speed, i.e., a value corresponding to the fuel quantity of one injection, is defined as the estimated intake air quantity Qaest.

Then, in S122, it is checked whether the estimated intake air quantity Qaest is greater than a prescribed value Qr. When the result is YES, next, in S124, a condition establishment decision delay timer (a down counter) is set to a value tm1 to initiate a down count (time measurement) and the subroutine is once terminated.

In the next and following subroutine execution cycles, when the result in S122 is again YES, the down counter is restarted in S124. When it is NO, it is checked in S126 whether the timer value tm1 has reached 0.

When the result in S126 is NO, the remaining steps are skipped. When it is YES, next, in S128, the detected air temperature TA is subtracted from the engine-start-time detected air temperature TAINIT to calculate the amount of decline in value TA detected by the outside air temperature sensor since the engine 10 started, whereafter it is checked whether the decline exceeds a prescribed value DTATHERM, i.e., whether the decline in the air temperature is greater than a threshold.

When the result in S128 is YES, meaning that the air temperature has declined appreciably, the bit of the flag F.MONTRM is reset to 0 in S130 to indicate that conditions for execution of thermostat malfunction detection or discrimination are not established. When the result is NO, meaning that either the air temperature decline is not large or the increase in the air temperature is large, the remaining steps are skipped (no decision is made finding that conditions for execution of thermostat malfunction detection or discrimination are not established).

Thus in this embodiment, as explained in more detail below, execution of thermostat malfunction detection or discrimination is decided based on the relation between the detected coolant temperature and the estimated coolant temperature, and the estimated coolant temperature is calculated from the detected coolant temperature at engine starting. The conditions for execution of malfunction detection or discrimination are therefore defined as being established when the engine 10 is in a state cooled to a temperature equal to the outside air temperature and the change in outside air temperature is small. Specifically, the conditions are defined as being established when the detected air temperature and detected coolant temperature at engine starting are within a prescribed range (S102) and the detected coolant temperature does not exceed the detected air temperature by more than a prescribed amount (S104).

Therefore, when the decline in the detected air temperature following engine starting is large (S128), the conditions are found not to be established because it can be assumed that the vehicle was left standing for too short a time or the outside air temperature declined considerably. For instance, when the engine 10 is started after insufficient soaking or when the outside air temperature is low and the engine 10 is started in a state soaked in a garage at a temperature higher than the outside air temperature, the conditions for execution of malfunction detection or discrimination are decided not to be established because it is likely that the engine 10 has not been cooled to as far as the outside air temperature.

On the other hand, when the outside air temperature sensor 30 is installed in the intake manifold for convenience of layout as shown in FIG. 1, the value of the actual air temperature sensor detection value may be higher than the outside air temperature even when the vehicle has thoroughly soaked because of heat accumulated in the intake manifold owing to sun exposure. In such a case, the sensor detection value may decline sharply immediately after starting of the engine 10 due to the intake of air under the high-load operation at this time. Otherwise, heat in the intake manifold may make it impossible for the sensor detection value to accurately track the air temperature when the rate of air temperature decline is high. In this case, too, the sensor detection value may decline sharply immediately after starting of the engine 10 due to the intake of air under the high-load operation at this time.

Such a sharp decline in the outside air sensor detection value during high-load operation immediately after engine starting is a transient or momentary phenomenon caused by dispersion of the heat in the intake manifold and is not a substantial hindrance to malfunction detection or discrimination.

This embodiment is therefore configured to carry out malfunction detection or discrimination also such cases. That is, this embodiment is configured to inhibit or prevent a decision that the conditions for execution of malfunction detection or discrimination are not established from being made is such a case. Specifically, this embodiment is configured to utilize the estimated intake air quantity Qaest (a parameter related to the quantity of intake air) to prevent a decision finding that the conditions for execution of malfunction detection or discrimination are not establish (prevent the flag F.MONTRM from being reset to 0).

More specifically, when the air temperature sensor detection value TA declines owing to dispersion of heat in the intake manifold, the amount of the decline can be expected to increase in proportion to the air intake quantity of the engine 10. The estimated intake air quantity Qaest is therefore calculated and compared with the prescribed value Qr, and when the circumstances are such that the estimated intake air quantity Qaest is greater than the prescribed value, the time of making the decision regarding whether or not the conditions for execution of malfunction detection or discrimination are established is delayed by the prescribed time tm1. Owing to this delay, malfunction detection or discrimination can be effectively carried out even under such circumstances.

From this viewpoint, the value of the prescribe time tm1 is appropriately set to one sufficiently long for the momentary or transient decline in the air temperature sensor detection value TA to run its course. Further, the threshold Qr is appropriately set to a value sufficient for discriminating circumstances in which a temporary or transient decline in the detection value may occur.

The method of detecting thermostat malfunction of this embodiment will now be summarized. The estimated coolant temperature CTW is calculated from the temperature condition and operating condition at engine starting (S32 in FIG. 3). When the estimated coolant temperature CTW has reached (i.e., is greater than) the judge-malfunction value CTWJUD but the detected coolant temperature TW has not reached the judge-normal value TWJUD, the thermostat 64 is discriminated to have malfunctioned (S300 to S308 in FIG. 13).

The estimated coolant temperature CTW is calculated as:

Estimated coolant temperature CTW=Engine-start-time detected coolant temperature TWINIT (S108 in FIG. 4)+Coolant temperature estimation basic value DDCTW (S30 in FIG. 3)×Coolant temperature estimation engine-start-time coolant temperature correction value KDCTW (S106 in FIG. 4).

Figure 9:
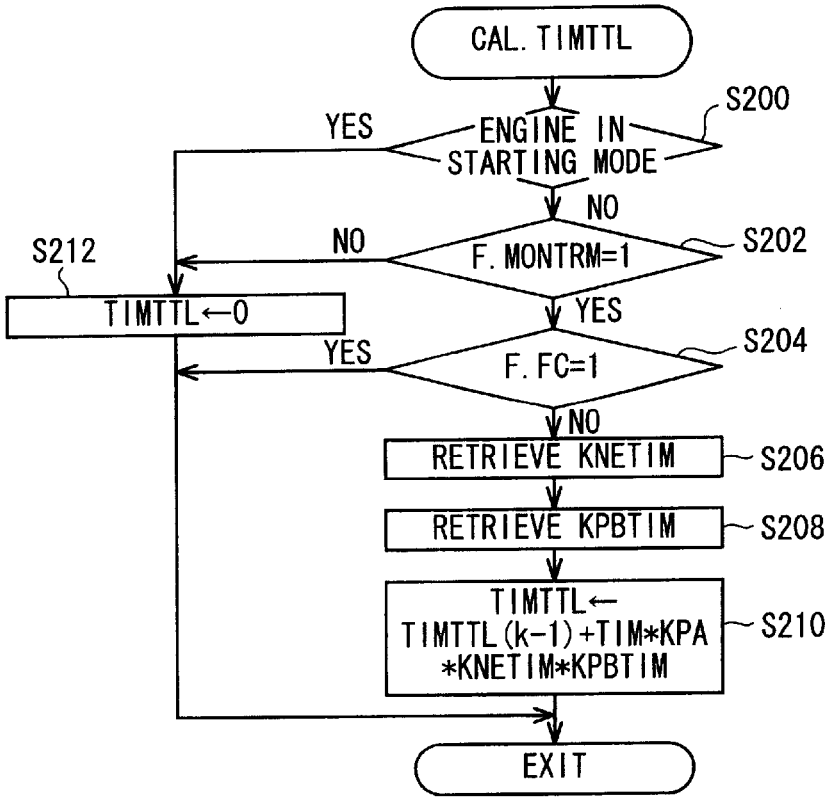
FIG. 9 is a flow chart showing the subroutine for calculating a totalized engine load TIMTTL to be used in calculating a totalized engine load for coolant temperature estimation TITTL referred to in the flow chart of FIG. 3.

The coolant temperature estimation basic value DDCTW increases in proportion to increase in the thermal load parameter contributing to coolant temperature rise (totalized engine load for coolant temperature estimation TITTL; S28 in FIG. 3). In consideration of this, the thermal load parameter is calculated from the totalized engine load TIMTTL (S200 to S212 in FIG. 9) and the totalized cooling loss CLTTL (cooling loss owing to passenger compartment heater and wind; S26 in FIG. 3.)

Figure 3:
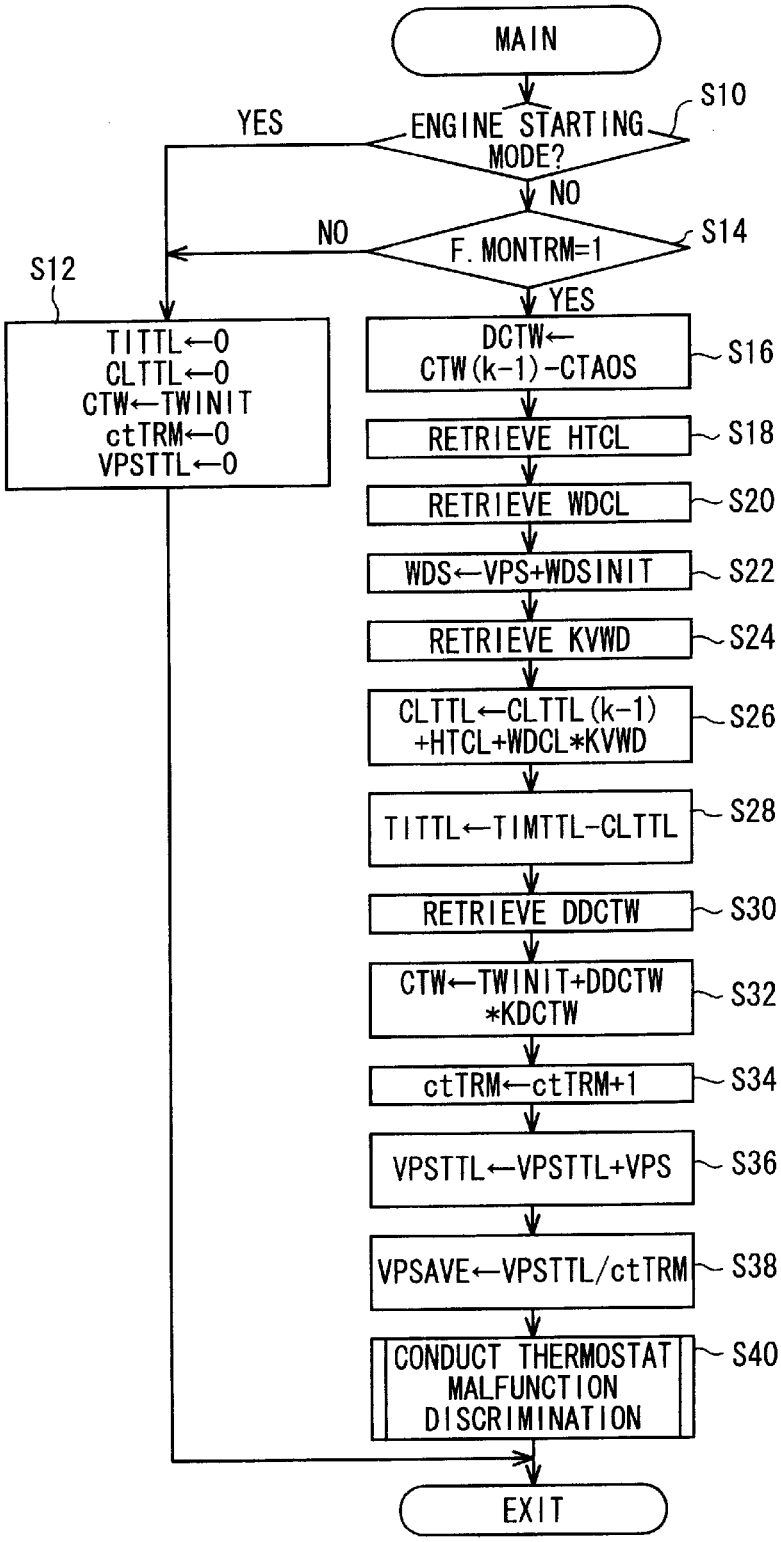
FIG. 3 is a flow chart showing the operation of the system illustrated in FIG. 1.

The explanation of FIG. 3 will be continued. In S14, it is checked whether the bit of the aforesaid flag is set to 1. When the result is YES, i.e., when it has been found that conditions for execution of thermostat malfunction detection or discrimination are established, then, in S16, a calculation is made to determine the difference DCTW between the estimated coolant temperature in the preceding cycle CTW (k−1) and the corrected engine-start-time air temperature CTAOS (the lower of the engine-start-time detected coolant temperature and the engine-start-time detected air temperature, as determined in S110 to S114).

In this specification and the drawings, the notation (k) indicates a sampling number in a discrete system, i.e., the interval of one activation cycle of the routine of FIG. 3. The notation (k−1) indicates that the value is that in the preceding cycle. (In the interest of simpler notation, (k) is not affixed to current cycle values.)

Figure 6:
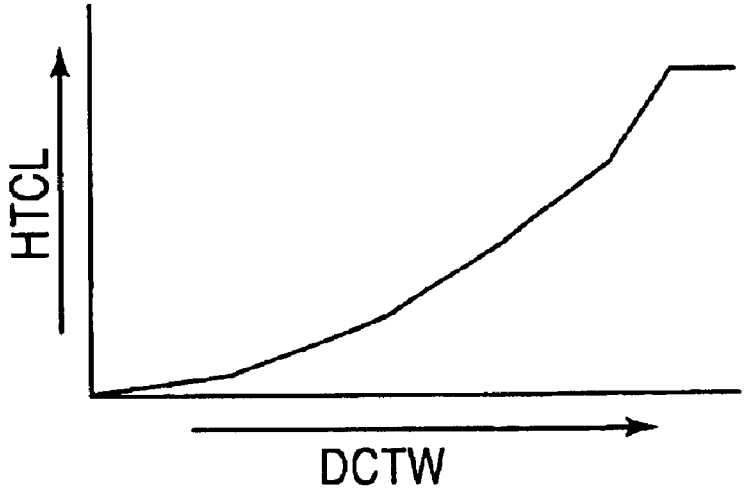
FIG. 6 PRIOR ART
FIG. 6 is a graph showing the characteristic curve of a heater cooling loss HTCL referred to in the flow chart of FIG. 3.

Next, in S18, the calculated difference DCTW is used to retrieve the heater cooling loss HTCL from a table compiled based on the characteristic curve shown in FIG. 6. By "heater cooling loss" is meant the loss occurring when high-temperature coolant is used to heat the passenger compartment.

The heater cooling loss HTCL increases in proportion to increase in the difference DCTW between the estimated coolant temperature and the outside air temperature (lower of the detected coolant temperature and the detected air temperature). It is expressed as a value corresponding to the fuel injection period (quantity of fuel injection) per unit time.

Figure 7:
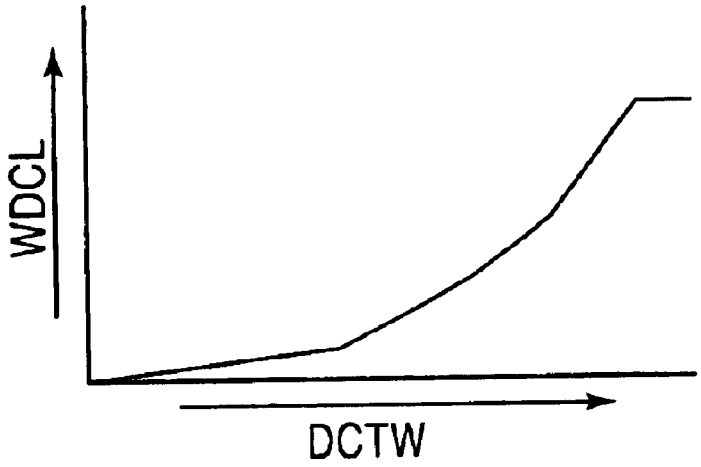
FIG. 7 PRIOR ART
FIG. 7 is a graph showing the characteristic curve of a wind cooling loss WDCL referred to in the flow chart of FIG. 3.

Next, in S20, the calculated difference DCTW is used to retrieve the wind cooling loss WDCL from a table compiled based on the characteristic curve shown in FIG. 7. For any given wind speed, the wind cooling loss WDCL also increases in proportion to increase of the difference DCTW. It is also expressed as a value corresponding to the fuel injection period (quantity of fuel injection) per unit time.

Next, in S22, a wind speed WDSINIT (fixed value) for a time of strong wind is added to the vehicle speed VPS detected by the vehicle speed sensor 54 to calculate an estimated relative wind speed WDS.

Figure 8:
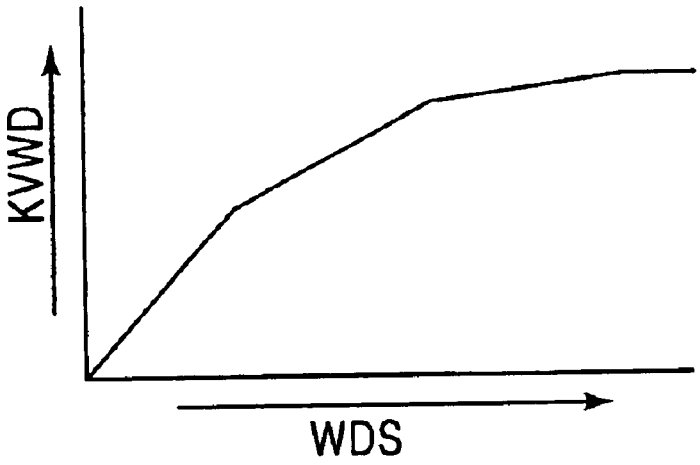
FIG. 8 PRIOR ART
FIG. 8 is a graph showing the characteristic curve of a wind-speed correction value KVWD referred to in the flow chart of FIG. 3.

Next, in S24, the estimated relative wind speed WDS is used to retrieve a wind-speed correction value KVWD from a table compiled based on the characteristic curve shown in FIG. 8.

Next, in S26, the totalized cooling loss CLTTL is calculated. Specifically, the product of the calculated wind cooling loss WDCL and the wind-speed correction value KVWD is added to the calculated heater cooling loss HTCL, the result is added to (used to update) the preceding-cycle totalized cooling loss CLTTL(k−1), and the sum is defined as the current-cycle totalized cooling loss CLTTL.

Next, in S28, the totalized engine load for coolant temperature estimation TITTL is calculated.

This is calculated based on the totalized engine load TIMTTL etc. The totalized engine load TIMTTL is calculated using the routine shown in FIG. 9, which is executed at a certain crank angle such as TDC.

First, in S200, the technique explained with reference to S10 is used to check whether the engine 10 is in starting mode. When the result is NO, it is checked in S202 whether the bit of the thermostat malfunction detection conditions established flag F.MONTRM is set to 1, i.e., whether conditions for execution of thermostat malfunction detection or discrimination are established.

Figure 10:
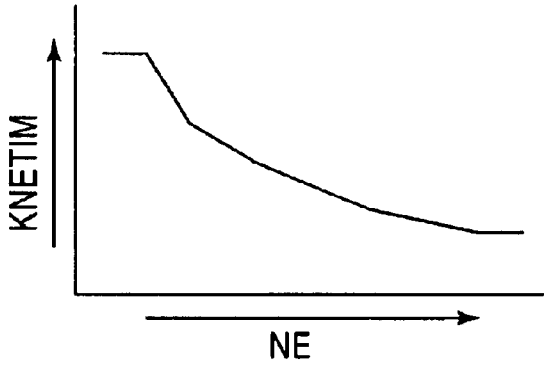
FIG. 10 PRIOR ART
FIG. 10 is a graph showing the characteristic curve of an engine speed correction value KNETIM referred to in the flow chart of FIG. 9.

When the result in S202 is YES, it is checked in S204 whether the bit of a flag F.FC is set to 1, i.e., whether fuel cutoff is in effect. When the result is NO, then, in S206, the detected engine speed NE is used to retrieve an engine speed correction value KNETIM from a table compiled based on the characteristic curve shown in FIG. 10.

Figure 11:
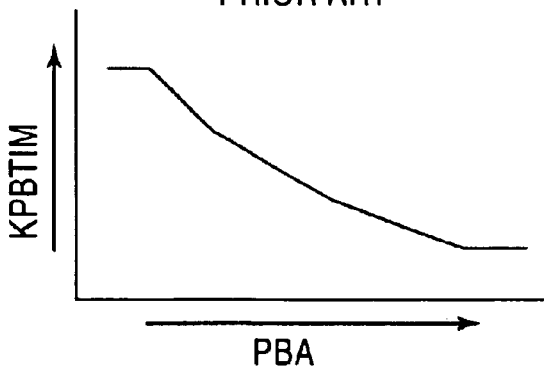
FIG. 11 PRIOR ART
FIG. 11 is a graph showing the characteristic curve of a load correction value KPBTIM referred to in the flow chart of FIG. 9.

Next, in S208, the detected manifold absolute pressure PBA is used to retrieve a load correction value KPBTIM from a table compiled based on the characteristic curve shown in FIG. 11, whereafter the totalized engine load TIMTTL is calculated in S210.

Specifically, the product of the basic fuel injection period TIM, a multiplication correction term KPA, the calculated engine speed correction value KNETIM, and the load correction value KPBTIM is added to (used to update) the preceding totalized engine load TIMTTL(k−1), and the sum is defined as the totalized engine load TIMTTL.

When the result in S200 is YES or the result in S202 is NO, accurate calculation of the totalized engine load is difficult, so the value of the totalized engine load is set to zero in S212. When the result in S204 is YES, the remaining steps are skipped because fuel is not being injected.

The explanation of FIG. 3 will be continued.

In S28, the totalized engine load for coolant temperature estimation TITTL is calculated based on the so-calculated totalized engine load. Specifically, the totalized cooling loss CLTTL is subtracted from the calculated totalized engine load TIMTTL and the difference is defined as the totalized engine load for coolant temperature estimation TITTL.

Figure 12:
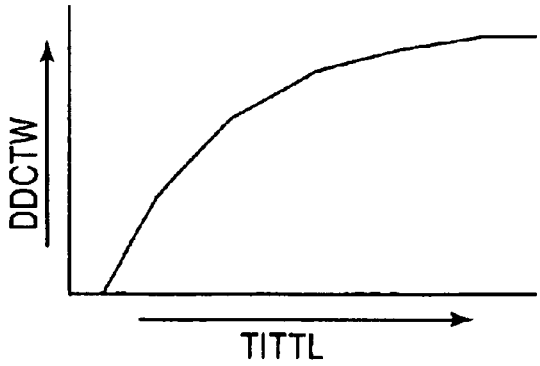
FIG. 12 PRIOR ART
FIG. 12 is a graph showing the characteristic curve of a coolant temperature estimation basic value DDCTW referred to in the flow chart of FIG. 3.

Next, in S30, the calculated totalized engine load for coolant temperature estimation TITTL is used to retrieve the coolant temperature estimation basic value DDCTW from a table compiled based on the characteristic curve shown in FIG. 12, whereafter the final estimated coolant temperature CTW is determined in S32.

Specifically, the product of coolant temperature estimation basic value DDCTW and the coolant temperature estimation engine-start-time coolant temperature correction value KDCTW (calculated in S106 of FIG. 4) is added to the engine-start-time detected coolant temperature TWINIT, and the sum is defined as the estimated coolant temperature CTW.

The value of the post-engine-starting counter ctTRM is then incremented by 1 in S34. Next, in S36, the totalized vehicle speed VPSTTL is updated by adding the vehicle speed VPS detected in the current cycle thereto.

Next, in S38, a post-engine-starting average vehicle speed VPSAVE is calculated by dividing the updated totalized vehicle speed VPSTTL by the post-engine-starting counter ctTRM.

Next, S40, it is discriminated or detected whether the thermostat 64 is normal or faulty (has malfunctioned).

Figure 13:
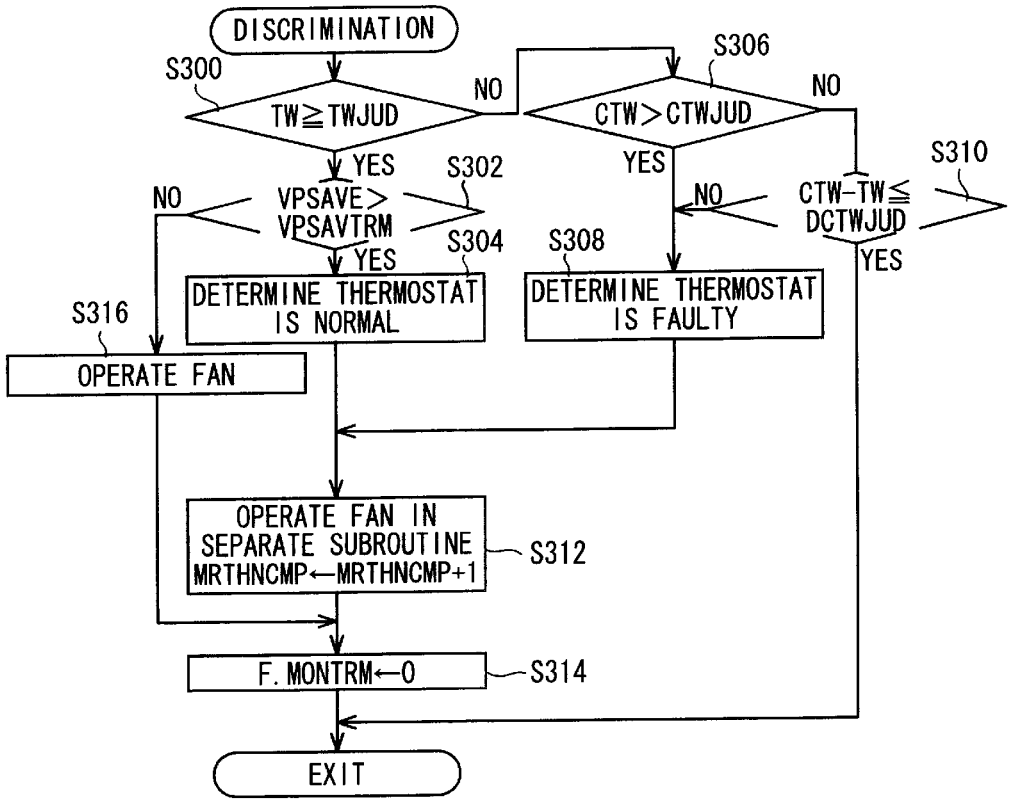
FIG. 13 is a flow chart showing the subroutine for discriminating or detecting whether the thermostat is normal or faulty (has malfunctioned) referred to in the flow chart of FIG. 3.

The subroutine for this is shown in FIG. 13.

First, in S300, it is checked whether the coolant temperature TW detected by the coolant temperature sensor 32 is equal to or greater than the judge-normal value TWJUD (e.g., 70° C.). When the result is YES, it is checked in S302 whether the average vehicle speed VPSAVE exceeds a reference value VPSAVTRM (e.g., 30 km/h). When the result is YES, the thermostat 64 is determined to be normal in S304.

When the result in S300 is NO, it is checked in S306 whether the estimated coolant temperature CTW is greater than the judge-malfunction value CTWJUD (e.g., 75° C.). When the result in S306 is YES, the thermostat 64 is determined to be faulty in S308, i.e., to have experienced a malfunction such as excessive leakage, too low valve opening temperature or open-state sticking.

When the result in S306 is NO, it is checked in S310 whether the difference obtained by subtracting the detected coolant temperature TW from the estimated coolant temperature CTW is equal to or less than a second judge-malfunction value DCTWJUD (e.g., 15° C.). When the result is NO, the thermostat is determined to be faulty in S308.

Thus, when the estimated coolant temperature reaches the judge-malfunction value before the detected coolant temperature reaches the judge-normal value, thermostat malfunction is determined. On the other hand, when the estimated coolant temperature is much higher than the detected coolant temperature, thermostat malfunction is determined even before the estimated coolant temperature reaches the prescribed value.

When the thermostat is found to be normal, a completed diagnoses counter is incremented in S312 and the bit of the flag F.MONTRM is reset to 0 in S314.

When the result in S302 is NO, i.e., when it is found that the radiator 60 is exposed to little wind owing to low vehicle speed (average vehicle speed), the discrimination or detection is delayed. This is to avoid a discrimination or detection error that might arise because under such a condition the coolant temperature rises rapidly even if the thermostat 64 is actually faulty.

Specifically, when the result is NO in S302, a separate subroutine not shown in the drawings is activated in S316. In this subroutine, the fan 76 is forcibly operated for a prescribed time period to cool the radiator 60 and then, after elapse of the prescribed time period, the detected coolant temperature TW and the judge-normal value TWJUD are compared, whereafter the thermostat is determined to be normal when the detected coolant temperature TW is equal to or higher than the judge-normal value TWJUD and is judged to be faulty when the detected coolant temperature TW is lower than the judge-normal value TWJUD.

As explained in the foregoing, this embodiment is configured so that malfunction of the thermostat is concluded to have occurred also when the estimated coolant temperature reaches the judge-malfunction value before the detected coolant temperature reaches the judge-normal value (or even before the estimated coolant temperature reaches the prescribed value if the estimated coolant temperature is much higher than the detected coolant temperature).

Specifically, an estimated coolant temperature is calculated from the coolant temperature at engine starting and thermal load parameters simulating radiator operation, the actual coolant temperature is detected, the estimated and actual coolant temperatures are compared with predetermined values, and presence/absence of thermostat malfunction is determined by discriminating the temperature rise characteristics of the two. Thermostat malfunctions such as excessive leakage, too low valve opening temperature and open-state sticking can therefore be detected with high accuracy and good response.

In addition, the estimated intake air quantity Qaest (a parameter related to the quantity of intake air) is utilized to inhibit a decision finding that conditions for execution of malfunction detection or discrimination are not established. Specifically, the estimated intake air quantity Qaest is compared with the prescribed value Qr and when the estimated intake air quantity Qaest is greater than the prescribed value, the decision as to whether the conditions for execution of malfunction detection or discrimination are or are not established is postponed by the prescribed time tm1 to prevent a premature negative conclusion. Malfunction detection or discrimination can therefore be carried out even when heat in the intake manifold installed with the air temperature sensor 30 causes a transient or momentary decline in the air temperature sensor detection value TA during high-load operation immediately after starting of the engine 10.

Figure 14:
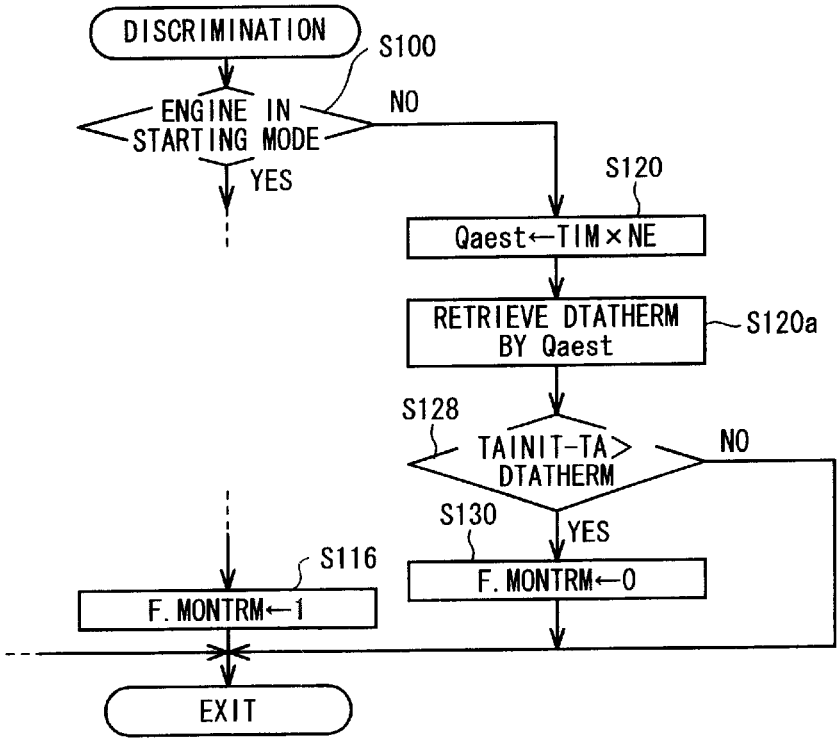
FIG. 14 is an abridged flow chart, similar to FIG. 4, but showing the operations of a system for detecting malfunction of an internal combustion engine radiator according to a second embodiment of the invention.

FIG. 14 is an abridged flow chart showing a part of the flow of processing operations in a system for detecting malfunction of an internal combustion engine radiator according to a second embodiment of the invention, specifically the steps for discriminating the establishment of conditions for execution of malfunction detection or discrimination corresponding to those of FIG. 4. Steps in FIG. 14 that are similar to ones in FIG. 4 are assigned the same step numbers as those in FIG. 4.

The points of difference from the first embodiment will be explained. When the result in S100 is NO, the estimated intake air quantity Qaest (a parameter related to the quantity of intake air) is calculated in the foregoing manner in S120.

Figure 15:
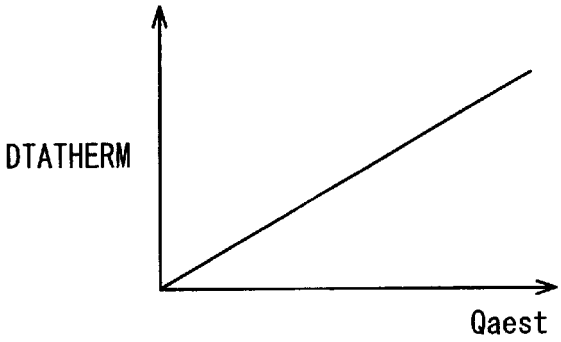
FIG. 15 is a graph showing the characteristic curve of a threshold DTATHERM referred to in the flow chart of FIG. 14.

Next, in S120*a*, the calculated estimated intake air quantity Qaest is used to retrieve the threshold DTATHERM from a table compiled based on the characteristic curve shown in FIG. 15. As shown, the threshold DTATHERM is defined to increase with increase of the estimated intake air quantity Qaest (a parameter related to the quantity of intake air).

Next, in S128, as in the first embodiment, the detected air temperature TA is subtracted from the engine-start-time detected air temperature TAINIT to calculate the amount of decline in the air temperature sensor detection value since the engine 10 started, whereafter it is checked whether the decline exceeds the threshold DTATHERM retrieved from the table, i.e., whether the decline in the air temperature is greater than the threshold.

When the result in S128 is YES, the bit of the flag F.MONTRM is reset to 0 in S130 to indicate that conditions for execution of thermostat malfunction detection or discrimination are not established. When the result is NO, the remaining steps are skipped.

In other words, since, as explained earlier, the amount of the decline in the air temperature sensor detection value can be expected to increase in proportion to the air intake quantity of the engine 10, the threshold is increased with increasing estimated intake air quantity Qaest so as to make a YES result in S128 unlikely even if the decline in the air temperature sensor detection value increases. As a result, a decision finding that the conditions for execution of malfunction detection or discrimination are not established is made less likely. This inhibits negative condition establishment decisions and makes it possible to carry out malfunction detection or discrimination even when heat in the intake manifold causes a transient or momentary decline in the air temperature sensor detection value TA during high-load operation immediately after starting of the engine 10.

Aside from its simplified aspects, the second embodiment has the same configuration and offers the same effects as the first.

Figure 16:
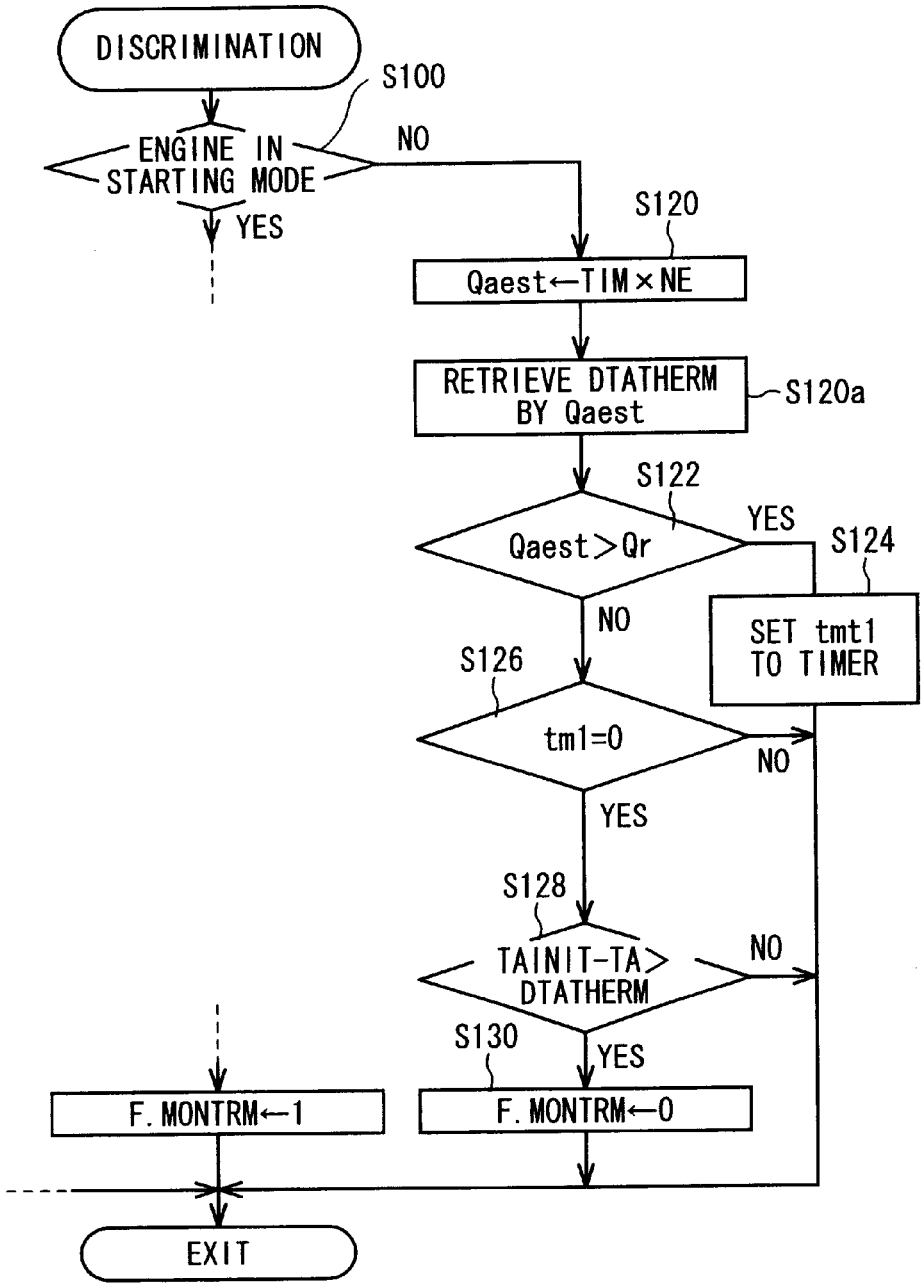
FIG. 16 is an abridged flow chart, similar to FIG. 4, but showing the operations of a system for detecting malfunction of an internal combustion engine radiator according to a third embodiment of the invention.

FIG. 16 is an abridged flow chart showing a part of the flow of processing operations in a system for detecting malfunction of an internal combustion engine radiator according to a third embodiment of the invention, specifically the steps for discriminating the establishment of conditions for execution of malfunction detection or discrimination corresponding to those of FIG. 4. Steps in FIG. 16 that are similar to ones in FIG. 4 or 14 are assigned the same step numbers as those in FIG. 4 or 14.

The points of difference from the first and second embodiments will be explained. When the result in S100 is NO, the estimated intake air quantity Qaest is calculated in S120. Next, in S120*a*, the calculated estimated intake air quantity Qaest is used to retrieve the threshold DTATHERM from a table compiled based on an unshown characteristic curve similar to that shown in FIG. 15.

Then, in S122, it is checked whether the estimated intake air quantity Qaest is greater than a prescribed value Qr. When the result is YES, next, in S124, a condition establishment decision delay timer is set to value tm1 to initiate a down count (time measurement) and the subroutine is once terminated.

When the result in S122 is NO and then the result S126 is NO, the remaining steps are skipped. When the result in S126 is YES, next, in S128, the detected air temperature TA is subtracted from the engine-start-time detected air temperature TAINIT to calculate the amount of decline in the air temperature sensor detection value since the engine 10 started, whereafter it is checked whether the decline exceeds the threshold DTATHERM retrieved from the table, i.e., whether the decline in the air temperature is greater than the threshold.

When the result in S128 is YES, the bit of the flag F.MONTRM is reset to 0 in S130 to indicate that conditions for execution of thermostat malfunction detection or discrimination are not established. When the result is NO, the remaining steps are skipped.

Since, as explained in the foregoing, the third embodiment combines features of the first and second embodiments, it still more effectively inhibits decisions finding that the conditions for execution of malfunction detection or discrimination are not establish and, as such, makes it possible to carry out malfunction detection or discrimination even when heat in the intake manifold causes a transient or momentary decline in the air temperature sensor detection value TA during high-load operation immediately after starting of the engine 10. In other aspects, the second embodiment is the same as the first and second.

The first to third embodiments are thus configured to have a system for discriminating malfunction of a radiator 60 having an inlet pipe 62 connected to an internal combustion engine 10 and a thermostat fitted in the inlet pipe to open the inlet pipe to pass engine coolant in the radiator to cool, comprising: engine operating condition detecting means (ECU 20, sensors 30, 32, etc.) for detecting operating conditions of the engine including at least an outside air temperature TA and a coolant temperature TW; outside air temperature decline amount calculating means (ECU 20, S128) for calculating a decline amount of the detected outside air temperature since starting of the engine (TAINT-TA); malfunction discrimination execution condition establishing deciding means (ECU 20, S128) for comparing the calculated decline amount of the detected outside air temperature (TAINT-TA) with a threshold value DTATHERM and for making a decision that conditions for execution of malfunction discrimination of the radiator are established, when the calculated decline amount of the detected outside air temperature is less than the threshold value; estimated coolant temperature calculating means (ECU 20, S26, S28, S200–S212, S30, S32) for calculating an estimated coolant temperature CTW based on at least the detected coolant temperature TW and a thermal load parameter contributing to coolant temperature rise TITTL, when the malfunction discrimination execution condition establishing deciding means makes the decision that the conditions are established; and malfunction discrimination executing means (ECU 20, S40, S300–S310) for comparing the estimated coolant temperature CTW and the detected coolant temperature TW with predetermined values CTWJUD, DCTWJUD and for discriminating whether the radiator has malfunctioned based on results of comparison; wherein the improvement comprises: malfunction discrimination execution condition non-establishing preventing means (ECU 20, S120–S126) for preventing the malfunction discrimination execution condition establishing deciding means from making the decision that the conditions are not established, utilizing a parameter related to a quantity of intake air (Qaest).

With this, an estimated coolant temperature is calculated from the coolant temperature at engine starting and thermal load parameters simulating radiator operation or approximating the radiator behavior, the actual coolant temperature is detected, the estimated and actual coolant temperatures are compared with predetermined values, and presence/absence of thermostat malfunction is determined by discriminating the temperature rise characteristics of the two. Malfunctions of the radiator, more precisely of the thermostat installed in the radiator, can therefore be detected with high accuracy and good response.

In addition, the invention provides means for inhibiting decisions finding that conditions for execution of malfunction detection or discrimination are not established. As this means utilizes a parameter related to the quantity of intake air of the internal combustion engine to prevent the malfunction detection/discrimination execution condition discrimination means from deciding that the conditions for execution of malfunction detection or discrimination are not established, it is therefore possible to inhibit decisions finding that the conditions for execution of malfunction detection or discrimination are not established in certain cases in which such a decision would ordinarily be unreasonably made, such as when the internal combustion engine is started while still insufficiently soaked or when the outside air temperature is low and the engine is started in a state soaked in a garage at a temperature higher than the outside air temperature so that heat in the intake manifold installed with the outside air temperature sensor causes a transient or momentary decline in the outside air temperature sensor detection value during high-load operation immediately after engine starting.

In the system, the malfunction discrimination execution condition non-establishing preventing means prevents the malfunction discrimination execution condition establishing deciding means from making the decision that the conditions are not established, by comparing the parameter Qaest with a prescribed value Qr such that a time of making the decision regarding whether or not the conditions are established, is delayed by a prescribed time, when the parameter exceeds the prescribed value. With this, based on the assumption that the amount of decline in the outside air temperature detection value caused by dispersion of heat in the intake manifold increases in proportion to a parameter related to the quantity of intake air of the internal combustion engine, the parameter is calculated and compared with a prescribed value, and when the circumstances are such that the parameter is greater than the prescribed value, the time of making the decision regarding whether or not the conditions for execution of malfunction detection or discrimination are established is delayed by the prescribed time tm1. Owing to this delay, effective malfunction detection or discrimination can be carried out when, for example, dispersion of the heat in the intake manifold installed with the outside air temperature sensor causes a transient or momentary decline in the outside air temperature sensor detection value during high-load operation immediately after engine starting.

In the system, the malfunction discrimination execution condition non-establishing preventing means prevents the malfunction discrimination execution condition establishing deciding means from making the decision that the conditions are not established, by increasing the prescribed value as the parameter increases (ECU 20, S120*a*). With this, based on the assumption that, as explained above, the amount of decline in the outside air temperature detection value TA increases in proportion to a parameter related to the quantity of intake air of the internal combustion engine, a threshold is increased in proportion to the parameter so as to make a decision finding that the conditions for execution of malfunction detection or discrimination are not established unlikely even if the amount of decline in the air temperature detection value increases. This makes it possible to carry out malfunction detection or discrimination even when heat in the intake manifold causes a momentary or transient decline in the air temperature sensor detection value during high-load operation immediately after starting of the engine.

In the system, the parameter related to a quantity of intake air is an estimated intake air quantity determined by a quantity of fuel injection TIM to be supplied to the engine and an engine speed NE, the thermal load parameter contributing to coolant temperature rise is a totalized engine load for coolant temperature estimation TITTL and the decline amount of the detected outside air temperature since starting of the engine is a difference between the detected outside air temperature TA and the detected outside air temperature at starting of the engine TAINIT.

The entire disclosure of Japanese Patent Application No. 2001-3151210 filed on Oct. 12, 2001, including specification, claims, drawings and summary, is incorporated herein in reference in its entirety.

While the invention has thus been shown and described with reference to specific embodiments, it should be noted that the invention is in no way limited to the details of the described arrangements but changes and modifications may be made without departing from the scope of the appended claims.

What is claimed is:

1. A system for discriminating malfunction of a radiator having an inlet pipe connected to an internal combustion engine and a thermostat fitted in the inlet pipe to open the inlet pipe to pass engine coolant in the radiator to cool, comprising:

engine operating condition detecting means for detecting operating conditions of the engine including at least an outside air temperature and a coolant temperature;

outside air temperature decline amount calculating means for calculating a decline amount of the detected outside air temperature since starting of the engine;

malfunction discrimination execution condition establishing deciding means for comparing the calculated decline amount of the detected outside air temperature with a threshold value and for making a decision that conditions for execution of malfunction discrimination of the radiator are established, when the calculated decline amount of the detected outside air temperature is less than the threshold value;

estimated coolant temperature calculating means for calculating an estimated coolant temperature based on at least the detected coolant temperature and a thermal load parameter contributing to coolant temperature rise, when the malfunction discrimination execution condition establishing deciding means makes the decision that the conditions are established; and malfunction discrimination executing means for comparing the estimated coolant temperature and the detected coolant temperature with predetermined values and for discriminating whether the radiator has malfunctioned based on results of comparison;

wherein the improvement comprises:

malfunction discrimination execution condition non-establishing preventing means for preventing the malfunction discrimination execution condition establishing deciding means from making the decision that the conditions are not established, utilizing a parameter related to a quantity of intake air.

2. A system according to claim 1, wherein the malfunction discrimination execution condition non-establishing preventing means prevents the malfunction discrimination execution condition establishing deciding means from making the decision that the conditions are not established, by comparing the parameter with a prescribed value such that a time of making the decision regarding whether or not the conditions are established, is delayed by a prescribed time, when the parameter exceeds the prescribed value.

3. A system according to claim 2, wherein the malfunction discrimination execution condition non-establishing preventing means prevents the malfunction discrimination execution condition establishing deciding means from making the decision that the conditions are not established, by increasing the prescribed value as the parameter increases.

4. A system according to claim 1, wherein the parameter related to a quantity of intake air is an estimated intake air quantity determined by a quantity of fuel injection to be supplied to the engine and an engine speed.

5. A system according to claim 1, wherein the thermal load parameter contributing to coolant temperature rise is a totalized engine load for coolant temperature estimation.

6. A system according to claim 1, wherein the decline amount of the detected outside air temperature since starting of the engine is a difference between the detected outside air temperature and the detected outside air temperature at starting of the engine.

7. A method of discriminating malfunction of a radiator having an inlet pipe connected to an internal combustion engine and a thermostat fitted in the inlet pipe to open the inlet pipe to pass engine coolant in the radiator to cool, comprising step of:

detecting operating conditions of the engine including at least an outside air temperature and a coolant temperature;

calculating a decline amount of the detected outside air temperature since starting of the engine;

comparing the calculated decline amount of the detected outside air temperature with a threshold value and for making a decision that conditions for execution of malfunction discrimination of the radiator are established, when the calculated decline amount of the detected outside air temperature is less than the threshold value;

calculating an estimated coolant temperature based on at least the detected coolant temperature and a thermal load parameter contributing to coolant temperature rise, when the step of malfunction discrimination execution condition establishing deciding makes the decision that the conditions are established; and comparing the estimated coolant temperature and the detected coolant temperature with predetermined values and for discriminating whether the radiator has malfunctioned based on results of comparison;

wherein the improvement comprises the step of:

preventing the step of malfunction discrimination execution condition establishing deciding from making the decision that the conditions are not established, utilizing a parameter related to a quantity of intake air.

8. A method according to claim 7, wherein the step of malfunction discrimination execution condition non-establishing preventing prevents the step of malfunction discrimination execution condition establishing deciding from making the decision that the conditions are not established, by comparing the parameter with a prescribed value such that a time of making the decision regarding whether or not the conditions are established, is delayed by a prescribed time, when the parameter exceeds the prescribed value.

9. A method according to claim 8, wherein the step of malfunction discrimination execution condition non-establishing preventing prevents the step of malfunction discrimination execution condition establishing deciding from making the decision that the conditions are not established, by increasing the prescribed value as the parameter increases.

10. A method according to claim 7, wherein the parameter related to a quantity of intake air is an estimated intake air quantity determined by a quantity of fuel injection to be supplied to the engine and an engine speed.

11. A method according to claim 7, wherein the thermal load parameter contributing to coolant temperature rise is a totalized engine load for coolant temperature estimation.

12. A method according to claim 7, wherein the decline amount of the detected outside air temperature since starting of the engine is a difference between the detected outside air temperature and the detected outside air temperature at starting of the engine.

13. A computer program embodied on a computer-readable medium for discriminating malfunction of a radiator having an inlet pipe connected to an internal combustion engine and a thermostat fitted in the inlet pipe to open the inlet pipe to pass engine coolant in the radiator to cool, comprising step of:

detecting operating conditions of the engine including at least an outside air temperature and a coolant temperature;

calculating a decline amount of the detected outside air temperature since starting of the engine;

comparing the calculated decline amount of the detected outside air temperature with a threshold value and for making a decision that conditions for execution of malfunction discrimination of the radiator are established, when the calculated decline amount of the detected outside air temperature is less than the threshold value;

calculating an estimated coolant temperature based on at least the detected coolant temperature and a thermal load parameter contributing to coolant temperature rise, when the step of malfunction discrimination execution condition establishing deciding makes the decision that the conditions are established; and comparing the estimated coolant temperature and the detected coolant temperature with predetermined values and for discriminating whether the radiator has malfunctioned based on results of comparison;

wherein the improvement comprises the step of:

preventing the step of malfunction discrimination execution condition establishing deciding from making the decision that the conditions are not established, utilizing a parameter related to a quantity of intake air.

* * * * *